US005379875A

United States Patent [19]

Shames et al.

[11] Patent Number: 5,379,875

[45] Date of Patent: Jan. 10, 1995

[54] COIN DISCRIMINATOR AND ACCEPTOR ARRANGEMENT

[75] Inventors: Howard Shames; William Carswell, both of Whitehall, N.Y.; Ronald Roberts, Fair Haven, Vt.; Larry Shulman, Queensbury, N.Y.; Gerald W. Smith, Vacaville, Calif.

[73] Assignee: EB Metal Industries, Inc., Whitehall, N.Y.

[21] Appl. No.: 227,498

[22] Filed: Apr. 14, 1994

Related U.S. Application Data

[63] Continuation of Ser. No. 916,191, Jul. 17, 1992, abandoned.

[51] Int. Cl.[6] ..... G07D 5/08

[52] U.S. Cl. ..... 194/317

[58] Field of Search ..... 194/317, 318, 319

[56] References Cited

U.S. PATENT DOCUMENTS

| | | | |
|---|---|---|---|
| 3,373,856 | 3/1968 | Kusters et al. . | |
| 3,870,137 | 3/1975 | Fougere . | |
| 3,901,368 | 8/1975 | Klinger . | |
| 3,918,564 | 11/1975 | Heiman et al. . | |
| 3,918,565 | 11/1975 | Fougere et al. . | |
| 3,952,851 | 4/1976 | Fougere et al. . | |
| 3,966,034 | 6/1976 | Heiman et al. . | |
| 4,105,105 | 8/1978 | Braum . | |
| 4,184,366 | 1/1980 | Butler | 194/317 X |
| 4,286,704 | 9/1981 | Wood . | |
| 4,353,453 | 10/1982 | Partin et al. . | |
| 4,361,218 | 11/1982 | Van Dort . | |
| 4,460,003 | 7/1984 | Barnes et al. . | |
| 4,460,080 | 7/1984 | Howard . | |
| 4,462,513 | 7/1984 | Dean et al. . | |
| 4,488,116 | 12/1984 | Plesko | 324/236 |
| 4,493,411 | 1/1985 | Heiman . | |
| 4,538,719 | 9/1985 | Gray et al. . | |
| 4,582,189 | 4/1986 | Schmitt | 194/317 |
| 4,601,380 | 7/1986 | Dean et al. | 194/318 |
| 4,742,903 | 5/1988 | Trummer | 194/317 |
| 4,845,994 | 7/1989 | Quinlan, Jr. | 73/163 |
| 5,007,520 | 4/1991 | Harris et al. | 194/317 |
| 5,060,778 | 10/1991 | Daw | 194/317 |
| 5,067,604 | 11/1991 | Metcalf | 194/203 |
| 5,083,652 | 1/1992 | Kobayashi et al. | 194/318 |

*Primary Examiner*—F. J. Bartuska
*Attorney, Agent, or Firm*—Leo Zucker

[57] ABSTRACT

Discrimination between genuine coins and unacceptable coins (i.e., slugs) deposited in a coin-actuated vending machine, is achieved by guiding a deposited coin for movement along a guide path, and positioning a disk-shaped coil which forms part of an oscillator circuit at a certain position relative to the first guide path such that coins of certain diameters will interact with flux produced by the coil when the latter is excited by the oscillator circuit and the coins are guided in proximity with the coil. Amplitude and frequency values each corresponding to operation of the oscillator circuit (1) in the absence of a proximate coin, and (2) when a deposited coin is at positions along the first guide path which are in proximity with the coil, are measured. Degrees of shift in the amplitude and the frequency values between measurements made at (1) and (2) are then determined. The determined degrees of shift are compared against known shift limits for acceptable (i.e., genuine) coins of interest, and an accept condition for a deposited coin is judged according to the comparison result.

38 Claims, 10 Drawing Sheets

COIN DISCRIMINATOR AND ACCEPTOR ARRANGEMENT

This application is a continuation, of application Ser. No. 07/916,191, filed Jul. 17, 1992,now abandoned.

BACKGROUND OF THE INVENTION

1. Field of the Invention

The present invention relates generally to coin currency receiving and accepting mechanisms, and more particularly to a coin discriminator and acceptor apparatus and method by which coins of various denominations deposited in a coin-actuated machine are individually analyzed electromagnetically inside the machine, and are either accepted or rejected prior to machine operation depending on the analysis results.

2. Discussion of the Known Art

Coin receiving mechanisms including means for determining the authenticity of a deposited coin, are generally known.

For example, U.S. Pat. No. 3,373,856 (Mar. 19, 1968) shows a method and apparatus for coin selection including a coin chute, a coin sizing and weighing mechanism, a coil sensing station, and a hinged selector gate. If a deposited coin passes the sizing and weighing mechanism near the entrance of the chute, the coin is directed between pole faces of a pair of magnetic cores at the sensing station. A winding on one magnetic core forms part of an oscillator which is set at a predetermined frequency. A detection winding on the second magnetic core is connected to selection circuits and senses a change of the magnetic field strength in the second core as the coin passes between the pole faces. Voltage induced in the detection winding is rectified and its peak amplitude is determined. If the detected peak voltage falls within preset limits, the coin is acceptable. Coins producing peak voltages below or above the preset limits are rejected.

Another technique of determining the authenticity of deposited coins is disclosed in U.S. Pat. Nos. 3,870,137 (Mar. 11, 1975), and 3,918,565 (Nov. 11, 1975). According to the patents, individual coins are subjected to electromagnetic fields of at least two substantially different frequencies by directing a deposited coin past a corresponding member of inductors as the coin moves along a track. The inductors are connected to low and high frequency oscillators, and changes in the oscillator frequencies are monitored as the coin passes and interacts with each inductor. If the frequency shifts in the low and high frequency oscillators fall within certain tolerances for acceptable coins, the deposited coin is determined to be acceptable. In the '565 patent, certain values corresponding to acceptable coins are prestored in a programmable memory, for comparison with frequency shift signals obtained when a deposited coin interacts with the plural inductors. If the frequency shifts are not within acceptable limits, the coin is rejected.

The known coin selector arrangements have certain disadvantages. For example, in the apparatus of the '856 patent, it is necessary to maintain precisely a narrow air gap between the pole faces of magnetic cores, and to direct each deposited coin between the narrowly gapped pole faces when performing a coin test. Minor changes in the air gap due to temperature fluctuations and wear, as well as variations in the thickness of the deposited coin, will over time have significant effects on the ability of the apparatus to make reliable determinations as to coin authenticity. In the arrangement of the '137 and '565 patents, for reliable operation it is necessary to ensure that all of the oscillator and inductor stages are properly physically aligned with the trajectory of a deposited coin, that successive measurements are performed in properly timed relation with the coin as it moves along the coin track, and that the rest frequencies of all the oscillators remain stable each at a predetermined value. Accordingly, the chances for erroneous measurement are compounded due to the need for at least two separately excited inductors for interaction with a moving coin.

SUMMARY OF THE INVENTION

An object of the present invention is to overcome the above and other shortcomings and disadvantages in the known coin discriminator and acceptor apparatus.

Another object of the invention is to provide a coin discriminator and acceptor arrangement in which only one sensing coil or inductor is needed to discriminate between an acceptable coin and a reject coin or "slug".

Yet another object of the invention is to provide a coin discriminator and acceptor arrangement using a single sensing coil wherein the stability of an associated oscillator circuit is not a critical factor when making a coin discrimination judgment.

A further object of the invention is to provide a coin discriminator and acceptor arrangement which, after making a determination of an acceptable coin, discriminates further for the dropping of the same accepted coin past an acceptor gate, thereby preventing "coin on string" types of theft.

According to the invention, a technique of discriminating between acceptable and unacceptable coins deposited in a coin receiving slot associated with a vending machine, includes the steps of guiding a deposited coin for movement along a first guide path, arranging first coil means in a frequency determining part of an oscillator circuit, and positioning the first coil means at a determined location relative to the first guide path thereby causing coins of certain diameters to interact with flux produced by the first coil means when the coil means is excited by the oscillator circuit and the coins are proximate the first coil means.

The method also includes measuring an amplitude value and a frequency value each corresponding to operation of the oscillator circuit (1) in the absence of a proximate coin, and (2) when a deposited coin is at positions along the first guide path which are in proximity with the first coil means, determining a degree of shift in said amplitude value between measurements made at (1) and (2), determining a degree of shift in said frequency value between measurements made at (1) and (2), comparing the degrees of shift obtained in both of the determining steps against known shift limits for acceptable coins, and judging an accept condition for a deposited coin according to a result in the comparing step.

According to another aspect of the invention, apparatus for discriminating between acceptable and unacceptable coins deposited in a slot associated with a vending machine, includes panel means arranged to be fixed to a part of a vending machine for defining a coin slot into which coins may be deposited from a front side of the panel means to operate the machine, support means fixed with respect to a rear side of the panel means, including guide means for guiding a deposited coin for movement along a first guide path, an oscillator circuit, and first coil means coupled to a frequency determining part of the oscillator circuit and positioned at a determined location relative to the first guide path, for causing coins of certain diameters to interact with flux produced by the first coil means when the coil means is excited by the oscillator circuit.

The apparatus also includes processor means for judging whether or not a coin deposited in the coin slot is acceptable to operate the associated machine. The processor means includes first means for measuring an amplitude value and a frequency value each corresponding to operation of the oscillator circuit (1) in the absence of a proximate coin, and (2) when a deposited coin is at positions along the first guide path which are in proximity with the first coil means, second means for determining a degree of shift in the amplitude value between the measurements made at (1) and (2), third means for determining a degree of shift in the frequency value between measurements made at (1) and (2), fourth means for comparing the determined degrees of shift with known shift limits for acceptable coins, and fifth means for judging an accept condition for a deposited coin according to an operational result of the fourth means.

For a better understanding of the invention, together with other and further objects, reference is made to the following description taken in conjunction with the accompanying drawing, and the scope of the invention will be pointed out in the appended claims.

DETAILED DESCRIPTION OF THE INVENTION

Figure 1:
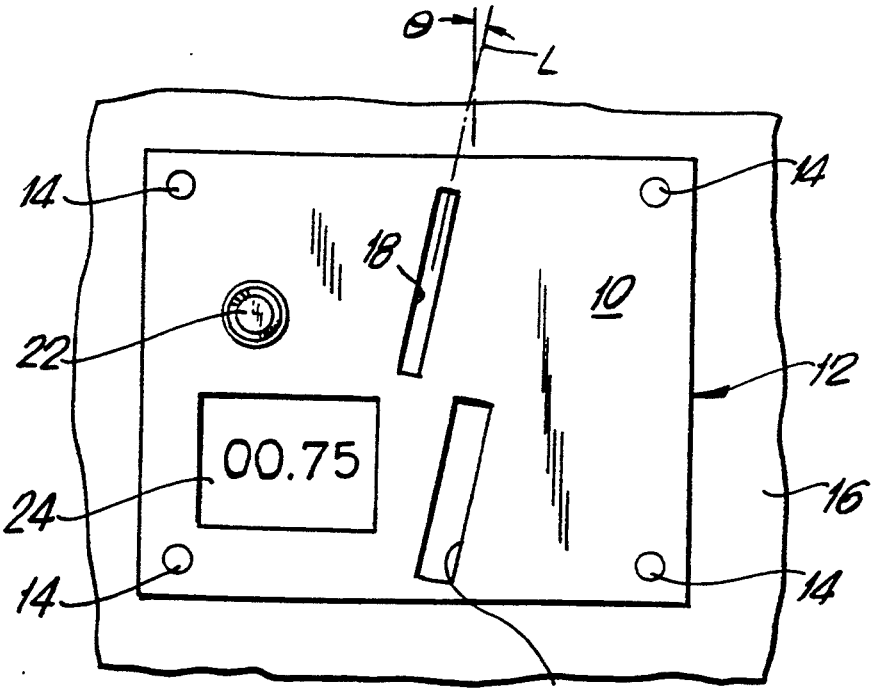
FIG. 1 is a front view of a face panel of coin discriminator and acceptor apparatus according to the invention.

FIG. 1 is a front elevational view of a face panel 10 of coin discriminator and acceptor apparatus 12, according to the invention.

Face panel 10 may be made of sheet metal material such as stainless steel, and measures at least about three inches square. Face panel 10 is riveted or otherwise secured by fasteners 14 to the front of a vending machine panel 16 with which the apparatus 12 is to be operatively associated. For example, the present apparatus 12 may be associated with clothes washing and drying machines of the kind provided in apartment houses and retail laundromats. The present apparatus 12 is not, however, limited in its application to one particular kind of vending machine and may be used advantageously in conjunction with any machine of the kind that requires the deposit of a minimum value of coin currency prior to vending an item, or otherwise completing a desired transaction. Further, as used herein, the term "coin" is intended to connote genuine coin currency, tokens, counterfeit coins, slugs, washers, and any other item that may be used by persons when attempting to operate coin-actuated devices.

The face panel 10 defines a rectangular coin slot 18 sized to permit passage of coins of denominations expected to be inserted into the apparatus 12 to operate the associated machine. That is, the height of the slot 18 should be just sufficient to accommodate coins having a largest expected diameter, and the width of slot 18 should be just sufficient to permit passage of coins having a greatest thickness among those expected to be deposited. Moreover, the long axis L of the slot 18 is inclined from the vertical by an angle Θ of about 10 degrees.

The face panel 10 also forms a return or reject slot 20 which is sized slightly larger than coin slot 18, and allows coins that have not been accepted by the apparatus 12 to be returned upon depression of a reject/return actuator button 22.

A four-character display unit 24 provides an alphanumeric character display on the face panel 10 of information such as the total value of coins to be inserted through the slot 18 in order to operate the associated machine. A displayed price, e.g., 00.75, may be decremented each time a coin deposited through slot 18 is accepted by the apparatus 12 thus informing the operator of an outstanding balance to be satisfied before completing a vend or other transaction. Display unit 24 may also be set by operation of internal switches (not shown) to display a series of interactive prompts to facilitate initial set-up of the apparatus 12, thus allowing the owner or operator of the machine to establish a desired price, type of coin (e.g., U.S. or Canadian), a running time to complete a vend (e.g., length of a washing or a drying cycle), and the like.

Figure 2:
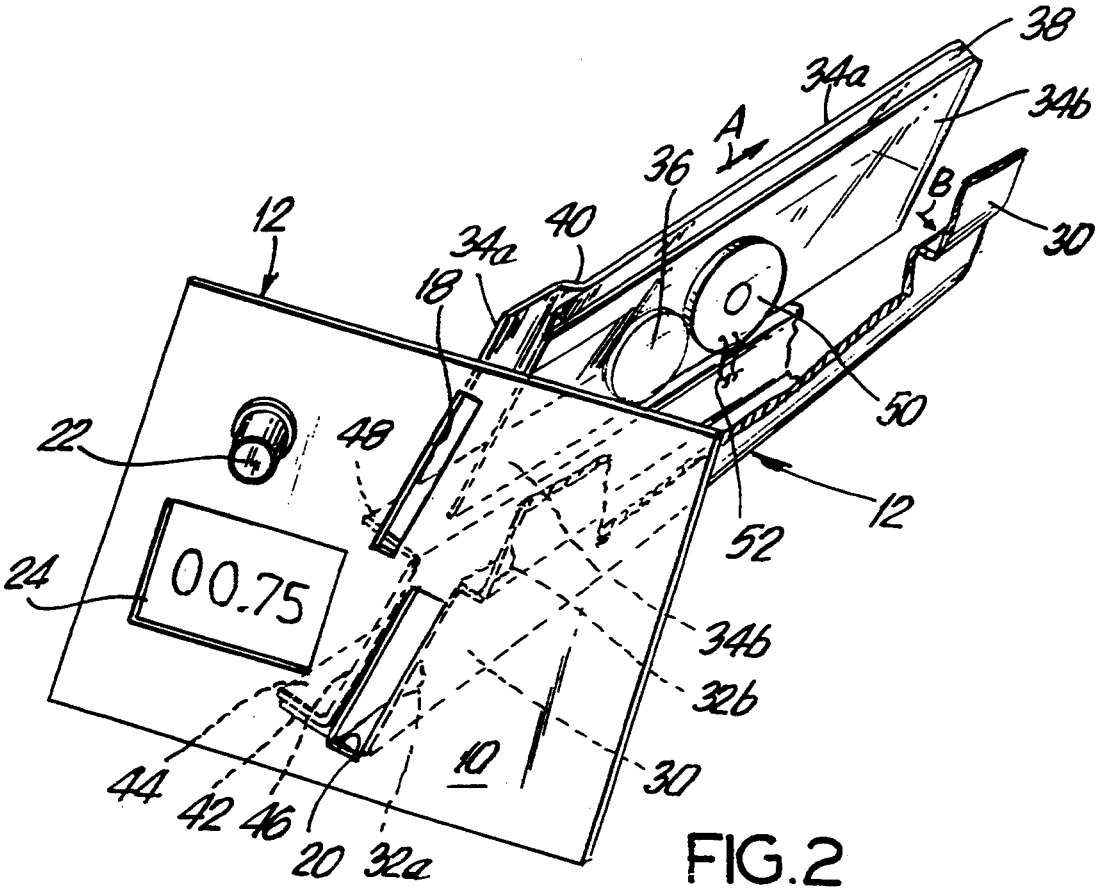
FIG. 2 is a perspective view of a portion of the present apparatus behind the face panel as seen from the upper right side in FIG. 1.

FIG. 2 is a perspective view showing parts of the apparatus 12 behind the face panel 10 as viewed from the upper right side in FIG. 1.

A chute bracket 30 extends perpendicularly behind the face panel 10 and is welded or otherwise securely fastened along an abutting edge at **32*a*, 32*b* to the rear surface of panel 10. Chute bracket 30 may extend about 4 inches behind the face panel 10 and serves to support certain mechanical and electrical mechanisms associated with the apparatus 12**.

Among the components supported by the chute bracket 30 are a pair of coin guide walls **34*a*, 34*b* that extend in parallel, spaced apart relation to one another over a distance of about 3 ¾ inches. The coin guide walls act as means for guiding a deposited coin 36 for movement along a first guide path in the direction of arrow A. Coin guide walls 34*a*, 34*b* may be formed of clear polycarbonate sheet material of 0,060 inch thickness, with a flat ⅛ inch thick elongated spacer 38 of like material sandwiched between the walls 34*a*, 34*b*. Spacer 38 extends in the region of the upper edges of the coin guide walls 34*a*, 34*b* thus forming a generally inverted U-shaped channel with sufficient clearance for the uppermost point on the circumference of the coin 36 as it slides and/or rolls between the guide walls beneath the spacer. As shown in FIG. 2, the end of the guide wall 34***a* closer to the coin slot 18 has an offset 40 serving to increase the distance between the inside surfaces of the guide walls, e.g., to 5/16 inch between the ends of the guide walls facing the coin slot 18. Also, the left wall 34*a* is set in alignment with the left edge of the coin slot 18 so that after a coin is inserted through the slot 18, a leading point on the coin circumference will impact against the offset 40 to be deflected through the narrower (⅛ inch) space between the guide walls further behind the face panel 10. Offset 40 serves to make uniform the translational velocity of coins as they move through the narrower spaced portion of the guide walls notwithstanding the entrance velocity of the coin through the slot 18.

Chute bracket 30 has a lower flange 42 extending toward the left in FIG. 2 and serving to support a lower flange 44 of a generally triangularly shaped chute 46. The chute 46 has an upper flange 48 spaced below the lower edges of the coin guide walls 34*a*, 34*b*. A front edge of the upper flange 48 is aligned with the bottom edge of the coin slot 18 as shown in FIG. 2, so that a deposited coin will be supported at lowermost points on its circumference by the chute upper flange 48 as the coin travels between the guide walls. The upper flange 48 inclines downwardly in the direction away from the back of the face panel 10, thus ensuring that the coin 36 will slide and/or roll under the influence of gravity through the first guide path between the walls 34*a*, 34*b*.

A first inductor coil 50 is cemented or otherwise securely adhered to the outside surface of coin guide wall 34*b*. Coil 50 is in the form of a flat disk shaped magnetic core such as the kind disclosed in the mentioned U.S. Pat. No. 3,870,137. A pair of coil leads 52 are directed to coin recognition circuits (FIG. 6) which may be located on a printed circuit board that is supported at a convenient location, either near the apparatus 12 or at a remote location (not shown). As shown in FIG. 2, coil 50 is positioned about 2¼ inches downstream of the front edge of right guide member 34*b*, and the center axis of the coil 50 is about ½ inch above the upper flange 48 of the chute 46 so as to coincide with the center, e.g., of a U.S. quarter or 25 cent piece.

The lower flange 42 of the chute bracket 30 is aligned with the lower edge of the return slot 20, and serves to support returned, rejected coins as they roll from a rear portion of the apparatus 12 back toward the face panel 10 between confronting faces of the chute bracket 30 and the chute 46. The coin reject and return mechanism and other details of apparatus 12 are explained in connection with FIG. 3.

Figure 3:
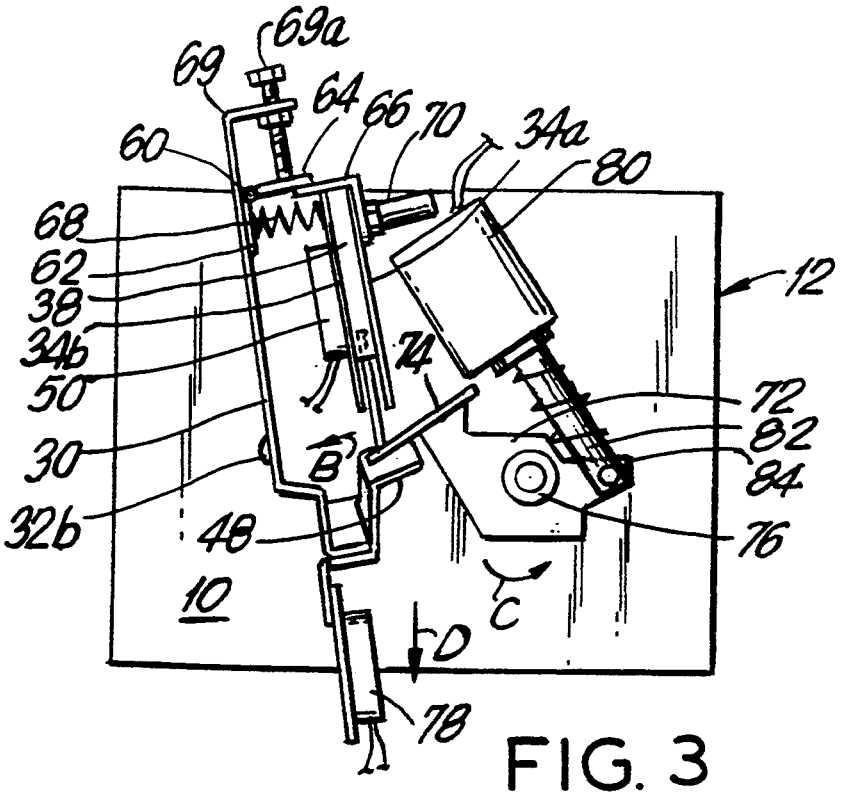
FIG. 3 is a rear elevational view of certain parts in present apparatus.

FIG. 3 shows the present apparatus 12 as viewed from the rear in FIG. 1.

The coin guide walls 34*a*, 34*b* with spacer 38 sandwiched between them, are supported for swinging movement in the direction of arrow B by way of a hinged bracket 60. Bracket 60 has one hinge leaf 62 fastened to the upper portion of the chute bracket 30, and another hinge leaf 64 is fastened to a right-angle member 66 from which the coin guide walls 34*a*, 34*b* with spacer 38 extend downwardly. A pair of bias springs one of which is shown at 68, serve to keep the coin guide walls at a coin receiving position as shown in FIGS. 2 and 3, i.e., in alignment with the coin slot 18 on the face panel 10. The coin guide walls can be set in position by way of an adjustment mechanism 69 attached to the chute bracket 30, including an adjustable screw 69*a* the distal end of which is in abutment with the top of the hinge leaf 64. A pin member 70 projects from the front end of the right angle member 66 in operative relation to part of a reject lever 71 (FIG. 3A) which is urged toward the rear of apparatus 12 when the reject actuator button 22 on the face panel 10 is depressed. Reject lever 71 is pivoted at its bottom end to a bracket which is fixed to the lower flange 44 of chute 46.

Figure 3A:
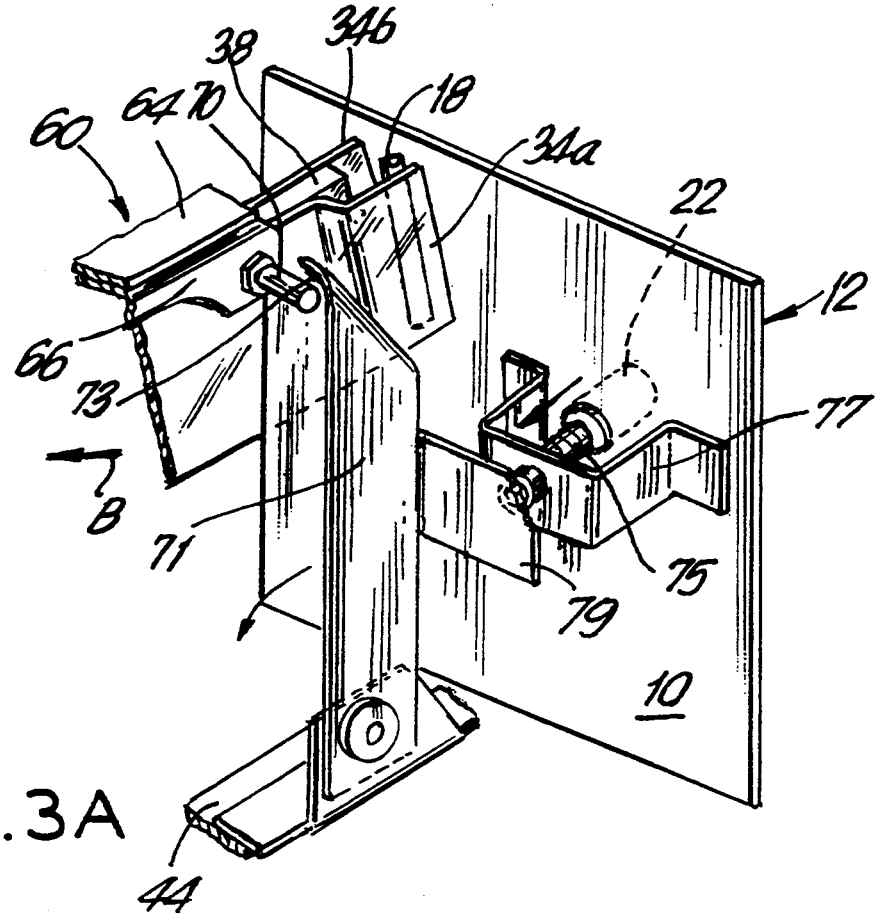
FIG. 3A is a detail view of coin return actuator parts in the apparatus.

As shown in FIG. 3A, pin member 70 confronts an inclined surface 73 of the reject lever 71. When the button 22 is pushed inwardly, a button shaft 75 which is supported for sliding movement by bracket 77, urges its distal end against an actuator surface 79 which projects at a right angle from the main body of the lever 71. As the button 22 is pushed in further, the inclined surface 73 contacts the pin member 70 and causes the coin guide walls 34*a*, 34*b* held in the angle member 66 to swing against the bias force of the spring 68 (FIG. 3), to a position aligned with the confronting faces of the chute bracket 30 and the chute 46 in FIG. 3. See arrow B in FIGS. 3 and 3A. Such movement results in the return of an unaccepted coin held at rest between the rear ends of the guide walls 34*a*, 34*b*, through a passage defined by the confronting wall surfaces of chute bracket 30 and chute 46, and out through the return slot 20 in the face panel 10 in FIG. 1. Unaccepted coins are held at rest between the rear ends of the guide walls 34*a*, 34*b* by a coin accept flap 72 which presents a coin arresting surface 74 just beneath the rear of coin guide walls 34*a*, 34*b*. The bottom edge of a deposited coin will therefore come to rest on the arresting surface of the flap 72 while confined between the guide walls. Flap 72 is pivoted at 76 for swinging movement between a coin non-accept position as shown in FIG. 3, and a coin accept position at which the surface 74 swings downwardly (arrow C) an amount sufficient to permit clearance for a deposited coin held at the rear of the guide walls to drop freely in the direction of arrow D into a coin box (not shown).

As an accepted coin descends into the coin box, it is directed past a second inductor coil 78 which operates as part of a post-accept gate discriminator stage, as explained below.

The swinging movement of the coin accept flap 72 is governed by an electromagnetic solenoid actuator 80 which is supported on a bracket (not shown) that is fixed to the lower flange 44 of the chute 46. The pivot shaft 76 is also supported by the actuator bracket, and armature 82 of the actuator 80 is pinned to an ear part 84 of the coin accept flap 72. Armature 82 is spring biased in the usual manner to assume a normally extended position as shown in FIG. 3, i.e., to maintain the coin arresting surface 74 of the flap 72 in a non-accept position as long as the actuator 80 remains unenergized. Further, like the first inductor coil 50, the second inductor coil 78 may be of the kind disclosed in U.S. Pat. No. 3,870,137 the relevant portions of which are incorporated by reference herein.

Figure 4:
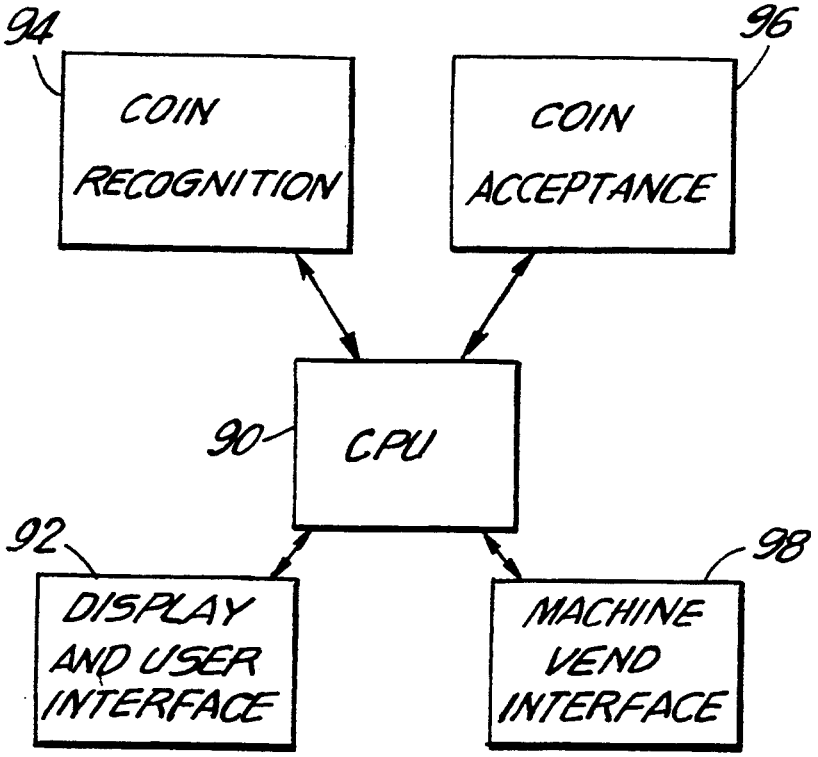
FIG. 4 is a block diagram of an overall system configuration in the present apparatus.

FIG. 4 is a block diagram of the overall system configuration for the apparatus 12.

Coin discrimination and acceptance by apparatus 12 are ultimately determined through the operation of a processor or central processing unit (CPU) 90 which, for example, may be in the form of an Intel type 8051 micro-controller. The CPU 90 is provided in the usual configuration with, e.g., a read-only-memory (ROM) in which an operating program for the apparatus 12 can be permanently stored, one or more random access memories (RAMs) and various input-output (I-O) devices as may be necessary to interface the CPU 90 with the various components of the apparatus 12.

The processor or CPU 90 provides data for display by the display unit 24 and otherwise enables selected persons to set initial operating parameters for the apparatus 12, such as by the mentioned series of interactive prompts and the user setting of internal switches (block 92). Processor 90 performs coin recognition (block 94) by way of the first inductor coil 50 and other circuitry described below, and determines whether or not a deposited coin should be accepted and credited (block 96) by performing certain operations on data obtained when the coin passes through lines of flux produced by the inductor coil (block 96). If a coin accept condition is determined by the processor 90, data is exchanged with a machine vend interface (block 98) to permit a vend or other transaction as a result of the depositing of a required amount of currency into the machine through the apparatus 12.

Figure 5:
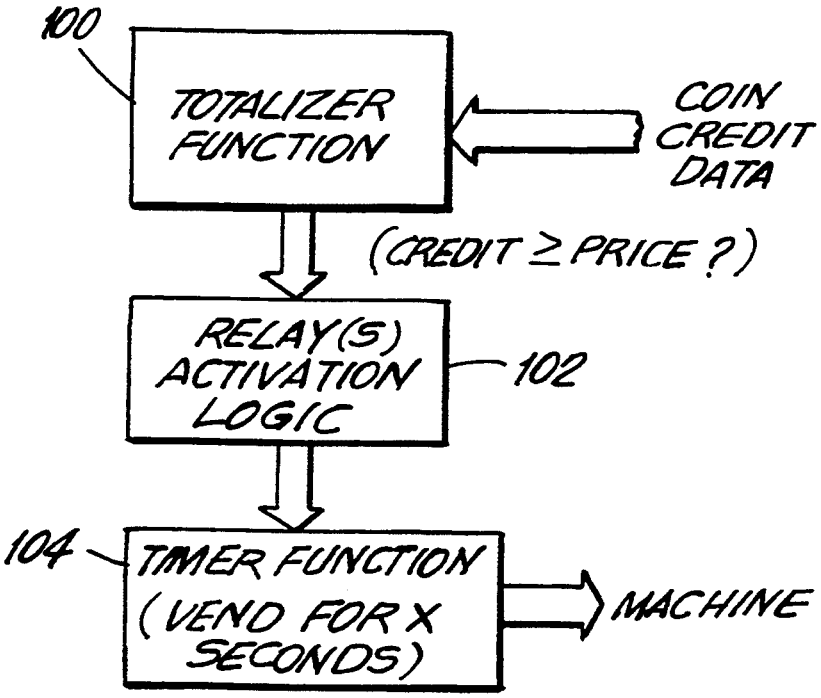
FIG. 5 is a block diagram of a vend interface subsystem.

FIG. 5 is a block diagram of a vend interface sub-system. The diagram shows details of the machine vend interface block 98 in FIG. 4.

A totalizer function (block 100) is implemented by the processor 90 by keeping a running count of valid coins deposited (decrementing the display unit 24 in FIG. 1 for each coin accepted) toward a vend or transaction. A corresponding price signal for the vend is preset in the apparatus 12 by the machine owner/operator. Once the total amount of coinage equals or exceeds the value represented by the price signal, the desired vend or transaction is implemented by activation of relays through associated logic circuitry (block 102). For certain transactions requiring a preset amount of time to complete such as a clothes washing or drying cycle, a timer function (block 104) is carried out for a preset number of seconds by appropriate logic circuitry.

Figure 6:
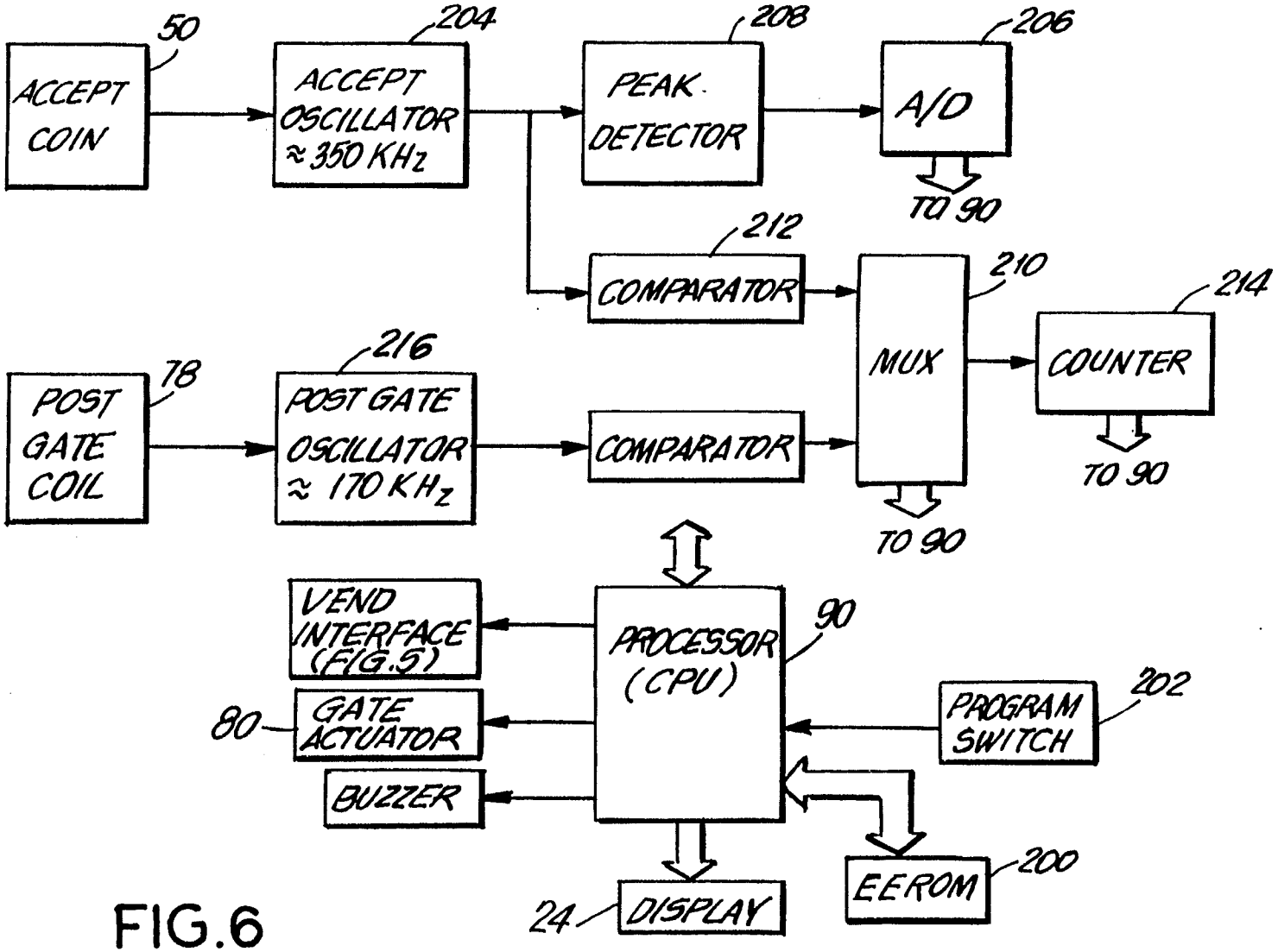
FIG. 6 is a schematic block diagram showing electrical and electro-mechanical components of the present apparatus, including coin recognition circuits and processing circuitry.

FIG. 6 is a block diagram of the overall operating system in the apparatus 12, and FIGS. 7A to 7H are flow charts depicting operational steps carried out by the system of FIG. 6.

An electronically erasable read only memory (EEROM) 200 is used to store several system parameters that can be modified using a push button program switch 202. The EEROM 200 may be device type 93C45 or 93C46. As mentioned, the processor or CPU 90 may be an Intel type 8051. Parameters that can be set via the EEROM and then modified include price, machine type, currency (U.S. or Canadian), lengths of timing or vend cycles, mode of operation, and the like.

Upon initial power-up (step S10), the CPU accesses the EEROM 200 and reads the stored parameters to determine its configuration for operation. The preset price is displayed in the four-character alpha-numeric display 24 (S12). As mentioned, any of the stored parameters can be changed by operating program switch 202 (S14), thus initiating a series of interactive display prompts (S16–S24) on the display 24 which the processor 90 presents while monitoring the program switch 202. Modified parameter settings are then stored in the EEROM 200 (S26). At completion, the display 24 shows price (S28) and waits in a main processing loop (S100) awaiting the deposit of a coin.

Figure 6A:
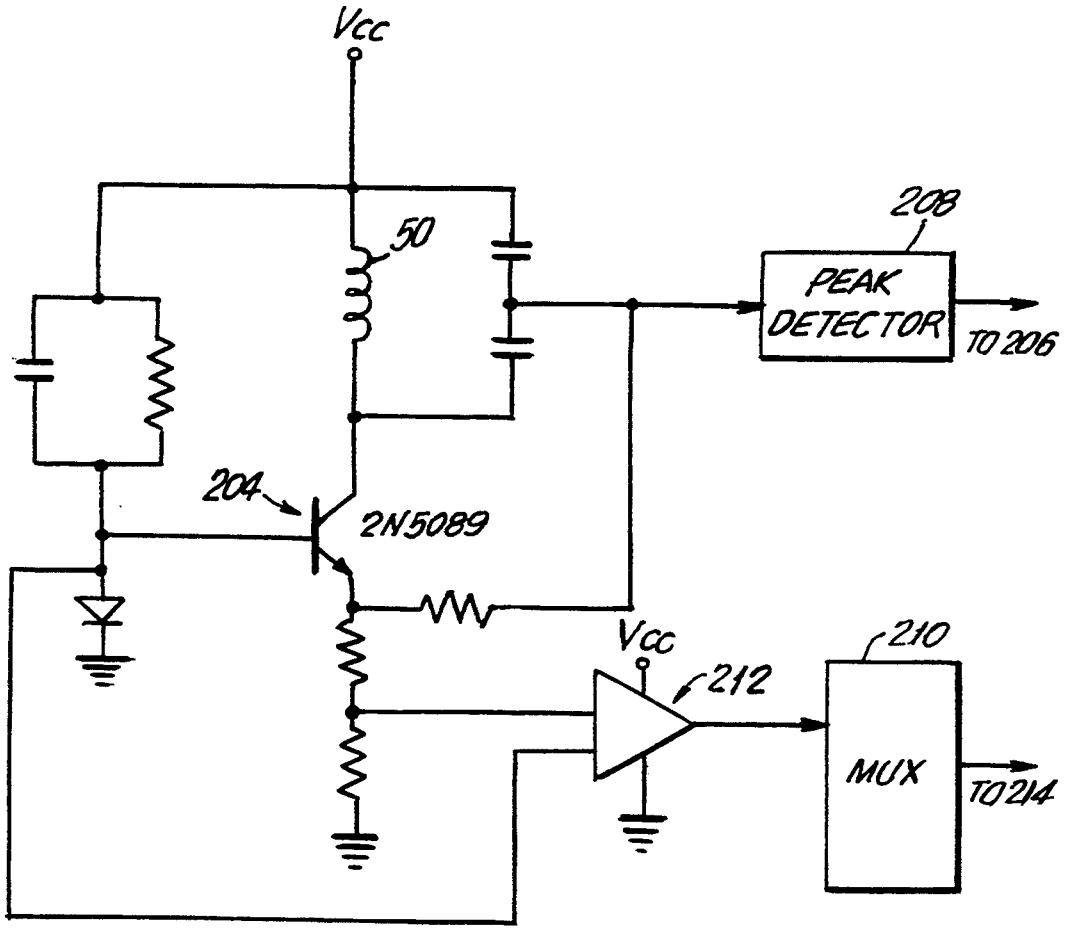
FIG. 6A is a schematic diagram of a coin accept coil and associated stages in FIG. 6.
Figure 7A:
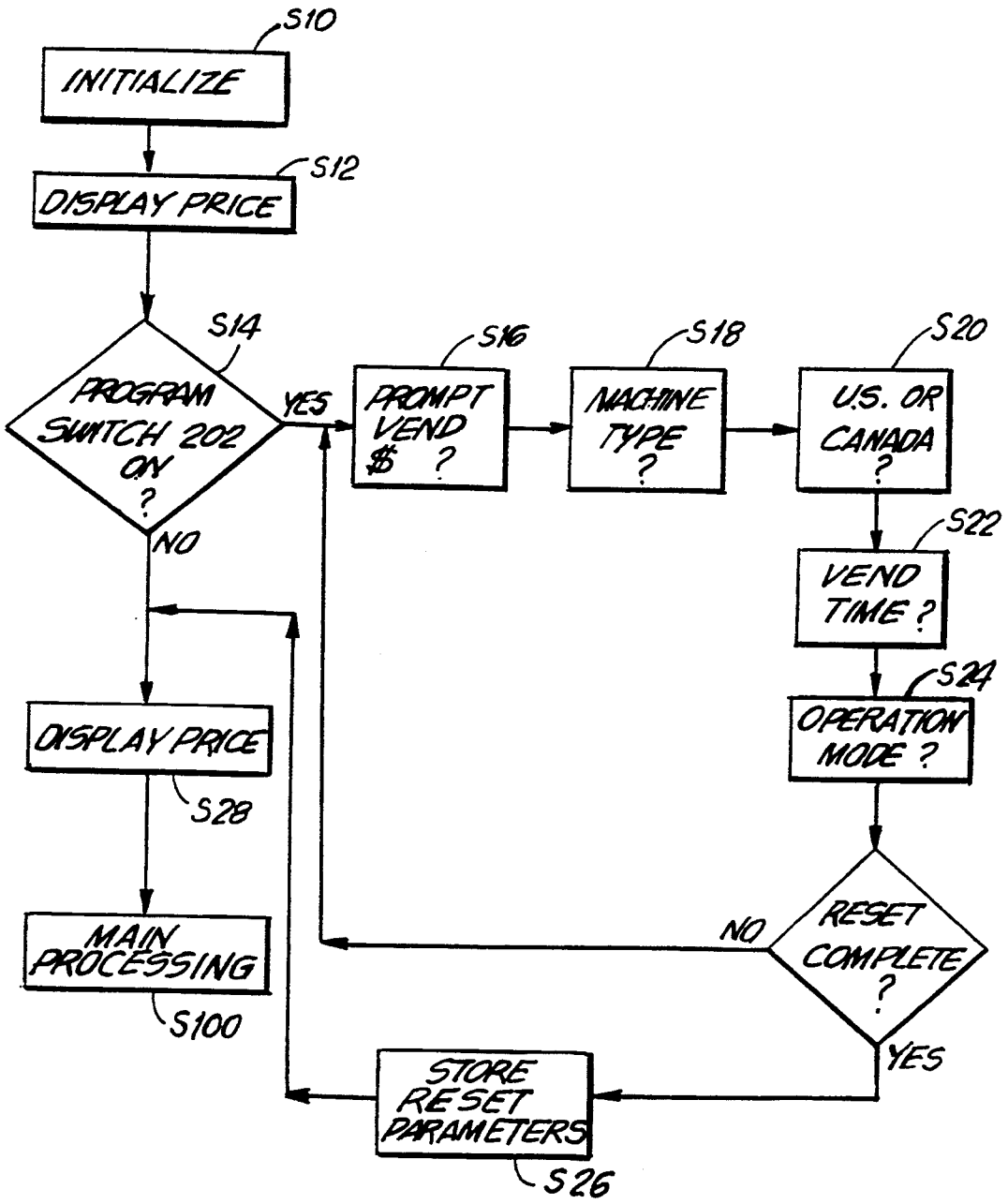
FIGS. 7A to 7H are flow charts illustrating operational steps carried out by the processing circuitry in FIG. 6.
Figure 7B:
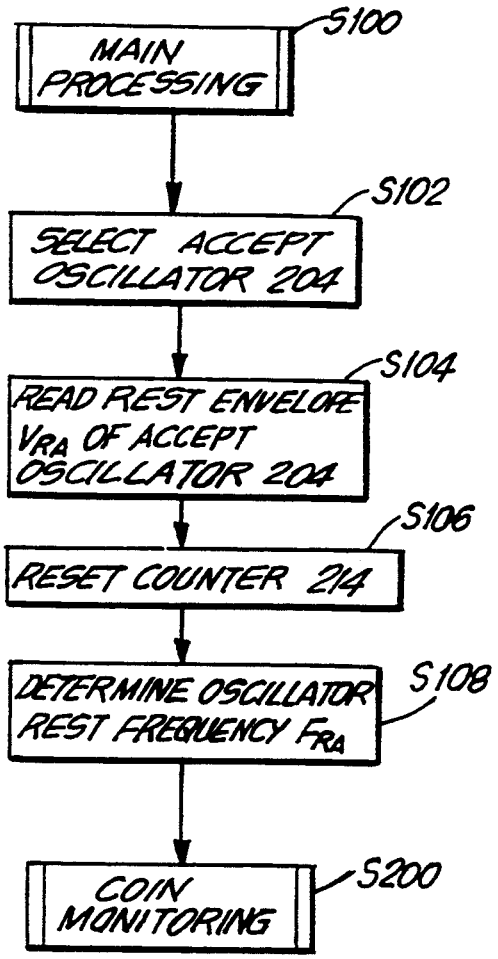
Figure 7C:
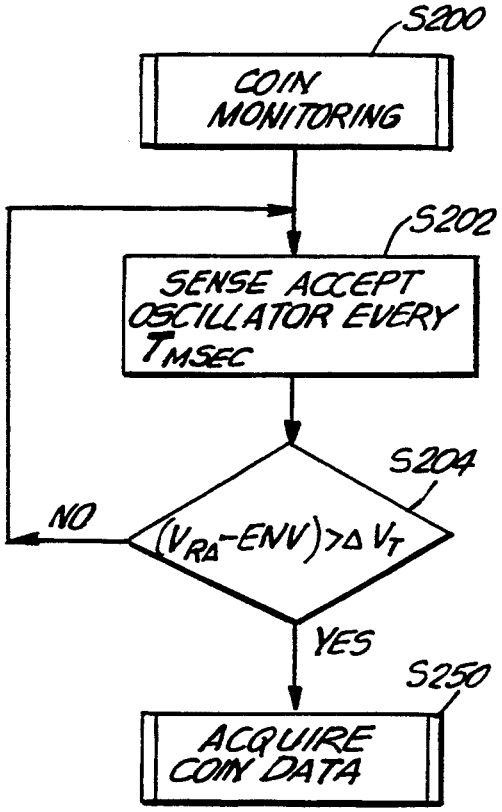
Figure 7D:
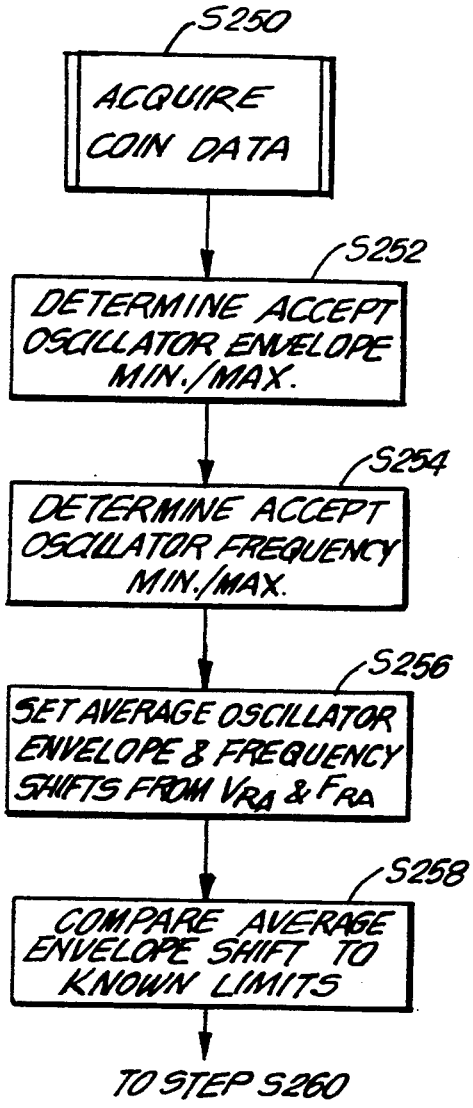
Figure 7E:
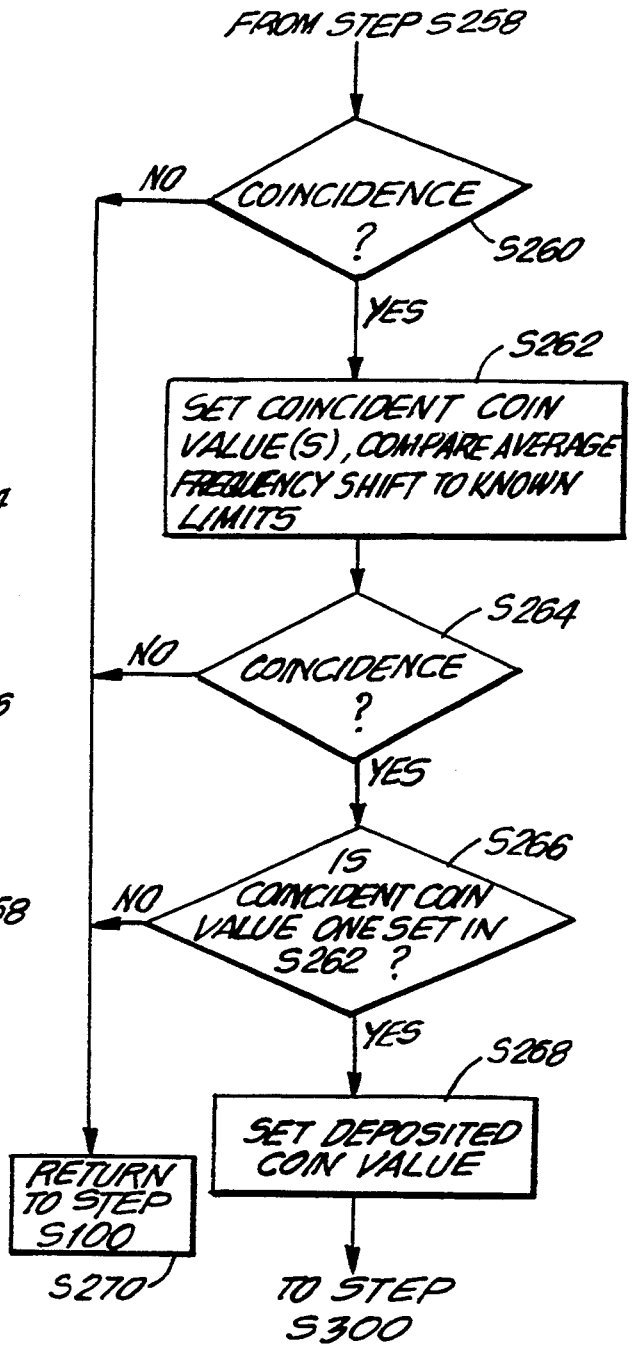
Figure 7F:
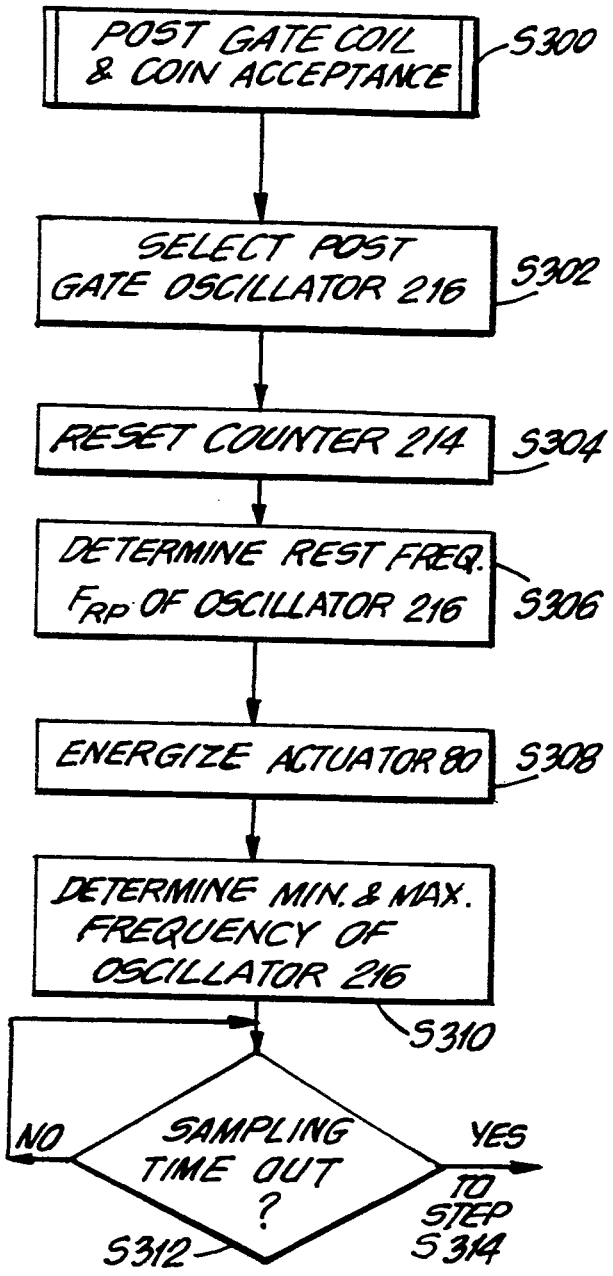
Figure 7G:
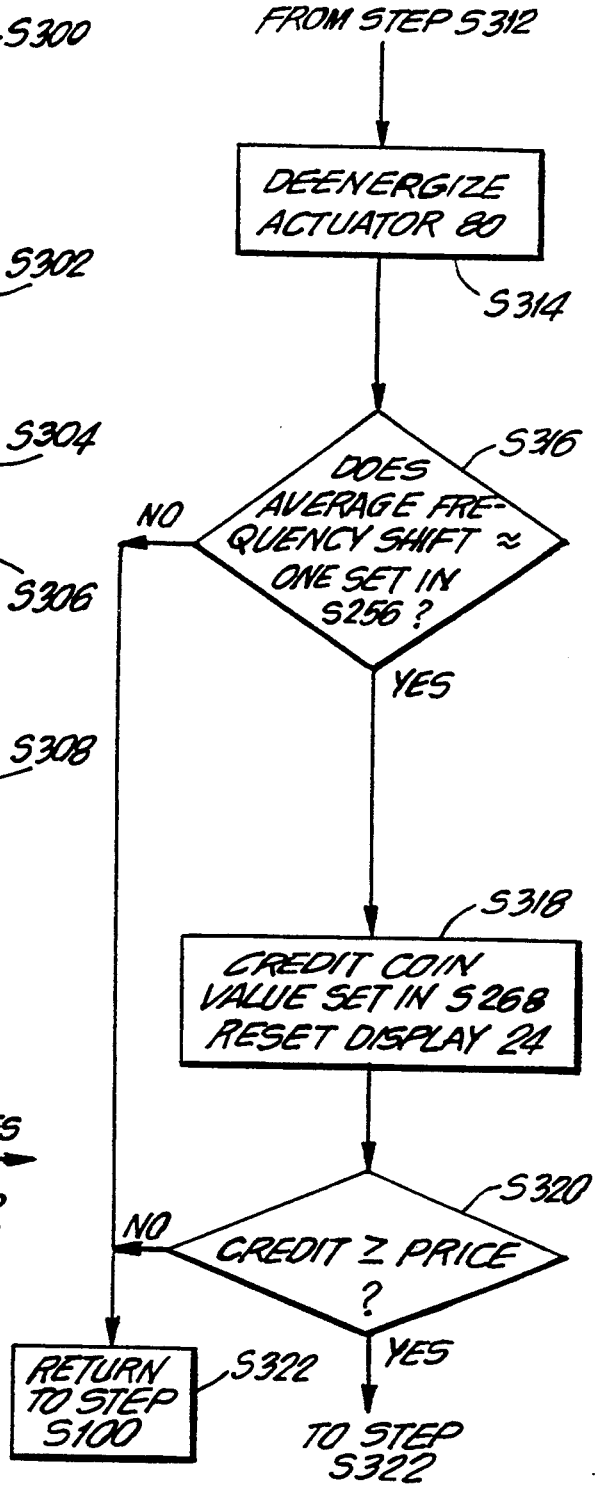
Figure 7H:
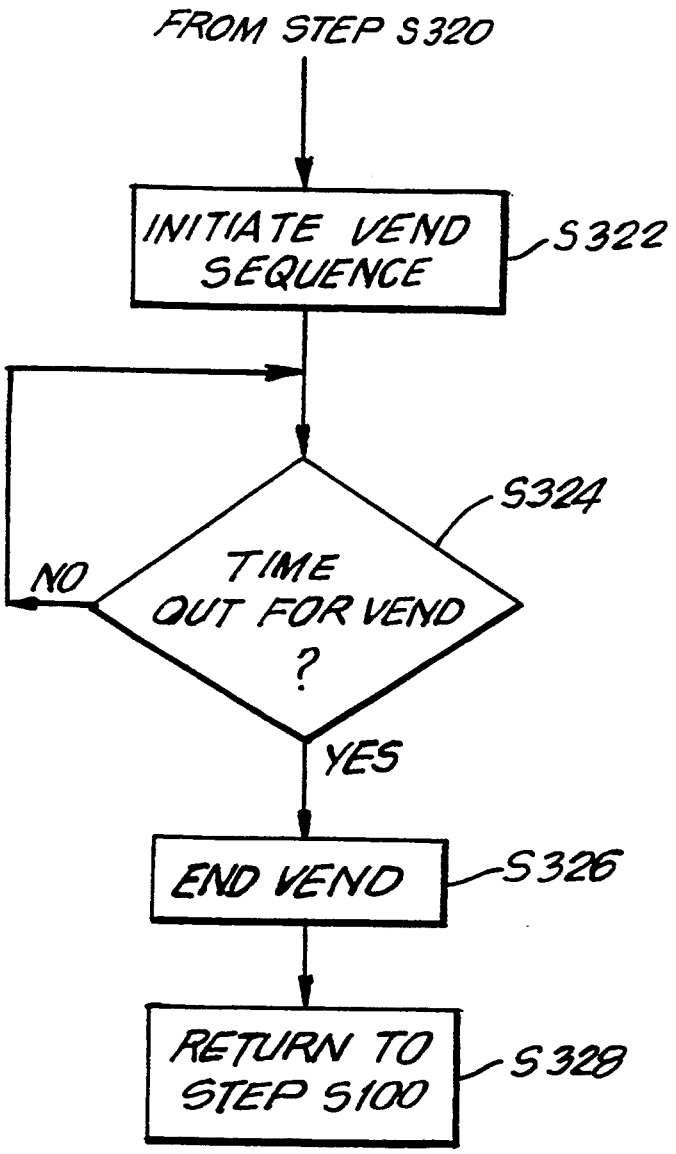

The first inductor coil 50, styled an "accept" coil in FIG. 6, is incorporated in an L-C tuned collector style oscillator stage 204 using a high $\beta$ transistor such as type 2N5089. FIG. 6A shows a typical operating configuration of the coil 50 with the oscillator stage 204.

Processor 90 first acquires a rest amplitude and a rest frequency reading for the oscillator stage 204. In the present embodiment, oscillator stage 204 is set at a rest frequency, i.e., without a coin or other metallic material in proximity to acceptance coil 50, of about 350 KHz. The amplitude reading is monitored (S104) by processor 90 by reading the output of an A/D converter 206 (type ADC0831) which is coupled to the envelope of the oscillator stage 204 (S102) through a peak detector stage 208. The frequency of oscillator stage 204 is monitored by processor 90 by selecting the oscillator stage 204 through a multiplexer MUX 210 (type 4053) and a comparator 212 (LM339). See FIG. 6A. The output of MUX 210 is applied to a counter 214 (CD4520). A frequency reading is obtained by resetting the counter 214 (S106), waiting a fixed period of time and reading the output of the counter 214 (S108).

Processor 90 then enters a coin monitoring mode (S200) in which it monitors the amplitude of the accept oscillator stage 204, for example, every 3–6 milliseconds (S202) looking for a decrease of the rest amplitude greater than a preset trigger level $\Delta V_T$ (S204). The trigger level will vary in accordance with the particular coins to be accepted. For the U.S. quarter, the trigger level corresponds to a decrease of 3–4 counts (60–80 mv) based on a rest envelope of about two volts. If such a decrease of the amplitude is detected, it is then determined that a coin has been deposited.

Processor 90 then enters a higher speed data acquisition mode (S250) in which it samples both the amplitude and the frequency of the accept oscillator stage 204. During this mode, processor 90 looks for maximum and minimum envelope amplitudes (S252), and maximum and minimum frequency readings (S254) in an attempt to classify the deposited coin. As the coin travels past the accept coil 50 it will cause the envelope amplitude and the frequency of oscillator stage 204 to vary from their rest values. The amount of variation of both amplitude and frequency is dependent on the diameter and the material content of the coin. Once the minimum and maximum values are acquired, the processor 90 operates to calculate the shift between an average of the maximum and minimum values, and the corresponding rest values for both amplitude and frequency (S256). The amplitude and frequency shifts are then used to determine if the deposited coin is genuine and can be credited toward the total amount needed to initiate a vend by the associated machine.

It has been found that oscillator frequency shifts are generally a function of the coin diameter, and that envelope amplitude shifts are a function mainly of the material of the coin.

Specifically, processor 90 operates to compare the average amplitude and frequency shifts calculated for the oscillator stage 204, to specific parameters known for the coins of interest. The specific parameters, i.e., amplitude and frequency shift values, are determined initially by dropping genuine coins of interest into the apparatus 12 and determining via the processor 90 and associated stages the range of acceptable amplitude and frequency deviations for the oscillator stage 204, for each known genuine coin.

The acquired average amplitude and frequency shifts for later coins deposited in the apparatus 12 are then compared to the known limits for genuine coins which limits may be part of the operating program for the processor 90 (S258–S266). If the amplitude and frequency shifts both fall within the known ranges for a single coin of interest, it is then judged that the deposited coin is of the same type and genuine (S268). If the coin fails to match either of the amplitude or the frequency shift limits for coins of interest, it is judged to be non-acceptable, i.e., a slug. Upon judging the presence of a slug, the processor 90 returns to the main processing mode (S270). If a coin is judged to be acceptable or valid, the processor 90 then looks at a post-gate oscillator stage 216 (S300) which is coupled to the second inductor coil 78 (post gate coil). Stage 216 is configured similarly to stage 204. The rest frequency of the stage 216 is, however, set at about 170 KHz. Processor 90 first reads the oscillator stage 216 through the MUX 210 and counter 214 to derive the rest post-gate oscillator frequency (S302–S306). The solenoid actuator 80 is then swung to an accept position to allow the coin to drop into the coin box (S308).

Next, processor 90 samples the post gate oscillator frequency looking for a shift exceeding a specific value indicative of the passage of the coin near the coil 78 (S310). If a coin is detected within an allotted time frame, e.g., within a number of milliseconds from energizing the actuator 80, the actuator 80 is de-energized to raise the coin accept flap 72, credit is applied and the displayed price is decremented to reflect the acceptance of the coin (S312–S318). If the coin is not detected within the allotted time frame, the actuator is de-energized to raise the coin accept flap 72, and credit is not applied for the coin (S314, S316, S322). Frequency shifts in the oscillator stage 216 can be analyzed in a manner similar to that performed with the oscillator stage 204, and the calculated shifts compared with those obtained for the same coin via the acceptance coil 50. Such a second gross analysis would allow for confirmation that a dropped coin was the same as one that was just accepted.

If a coin is accepted and the price is decremented to zero, a vend sequence is performed (S320–S326). As mentioned, display 24 can also show and count down a preset run time.

Once all the above operations are complete, processor displays the preset price on display 24 and returns to the main processing mode (S328).

By way of example only and without limitation of the apparatus 12 to the specific values disclosed, the following parameters for the accept oscillator stage 204 have provided satisfactory operating results for current style U.S. and Canadian coins.

EXAMPLE ONE

Coin: U.S. quarter dollar (cladded, copper core)

Acceptable frequency shifts from 350 KHz rest frequency:

fmin=350 KHz (no shift)

fmax=368.8 KHz (+18.8 KHz shift)

Acceptable envelope amplitude shifts from 2.0 p-p rest amplitude:

Emin=1.900 v. (−100 mv. p-p shift)

Emax=1.920 v. (−80 mv. p-p shift)

EXAMPLE TWO

Coin: Canadian quarter dollar

Acceptable frequency shifts from 350 KHz rest frequency:

fmin=350 KHz (no shift)

fmax=366.8 KHZ (+16.8 KHz shift)

Acceptable envelope amplitude shifts from 2.0 p-p rest amplitude:

Emin=1,840 v. (−160 mv. p-p shift)

Emax=1.860 v. (−140 mv. p-p shift)

EXAMPLE THREE

Coin: Canadian dollar (Loon)

Acceptable frequency shifts from 350 KHz rest frequency:

fmin=350 KHz (no shift)

fmax=370 KHz (+20.0 KHz shift)

Acceptable envelope amplitude shifts from 2.0 p-p rest amplitude:

Emin=1,760 v. (−240 mv. p-p shift)

Emax=1,780 v. (−220 mv. p-p shift)

Broadly stated, the present method and apparatus serve to examine properties of coins by causing them to interact with an electromagnetic field generated by a first coil excited at one preset frequency. A determination that a coin is acceptable is made only after the coin has satisfied examination requirements directed to both amplitude and frequency variations monitored while the coin passes and interacts with the single coil. Once the coin is determined to be acceptable, an acceptor gate opens to allow the coin to drop over a path where it may interact with a second coil and be subjected to a second gross analysis for being the same coin as was accepted previously. The latter step represents a combined proximity detector and post-gate discriminator.

A single, self-excited oscillator is coupled to the first coil. A coin channel comprised of two spaced parallel walls and a support flange onto which the deposited coin first lands, is constructed and arranged so as to present a side of the coin against that wall of the channel on which a face of the coil is positioned. As the coin interacts with the coil, a history of its flight is recorded in a memory associated with a central processing unit (CPU).

Both amplitude and frequency variations are analyzed. The number of samples above a trigger value can also stored as part of the data gathering. Both maximum and minimum values are searched for and compared against standby or rest values. This additional step allows the CPU to look at swamping effects on the oscillator as well as other phenomena that occur with non-traditional metal combinations in coins to be examined. The values are averaged and the deviations from the rest values are calculated. The calculated values are compared with empirically determined values for known coins of a given set, for example, the current series of Canadian quarter dollar and dollar coins. If the values are within known limits the event is promoted to a "valid coin detected" state and the accept flap is opened to divert the coin to the accept coin path.

As the coin drops past the accept flap and enters the accept coin path, an oscillator energizes a second coil to detect the arrival of the coin. This prevents "coin string" frauds. The apparatus also keeps a peak frequency measurement of the event independent of a "close flap" trigger level. This peak frequency is used with the rest frequency of the oscillator to arrive at a f(max)−f(min) value, and the value is compared to known limits to ensure the coin that arrived past the accept flap is of the same "class" as the coin accepted. This prevents certain types of "two coin" theft attempts.

If a deposited coin is properly accepted and matches the class of coin that was discriminated, the CPU gives credit to the event and totalizes an appropriate credit line to inform an attached control system that a coin of value "X" was just accepted.

Since the first coil is centered a certain distance above the coin channel bottom, it forms a crude first order diameter/thickness discrimination circuit. That is, smaller diameter coins will not cut as many lines of flux generated by the L-C oscillator than larger diameter coins which are coextensive with the first coil face, and will therefore be more easily discriminated; even when the smaller diameter coin is of the same material as a larger diameter coin in the same set. Accordingly, the apparatus 12 is particularly suited to restrictive coin applications wherein, for example, only larger diameter coins of a given coin set are to be examined such as quarters and dollars. Smaller diameter coins will not be recognized or accepted even if valid, and will be held for return to a customer upon actuation of the reject-/return button 22.

It will be appreciated that the apparatus 12 provides the following features:

A. Coin thickness, diameter, and aggregate material are all determined by a single one-sided oscillator coil running at one dominant frequency. The prior arrangements use more than one oscillator and/or two-sided coils to perform coin tests.

B. Positioning of the first coil relative to the coin bottom support flange forms a first order diameter sensor. Multiple coin sets can be discriminated at the same time.

C. Compensation of the test circuitry is handled by adaptive software and multiple lookup routines. This saves expensive temperature and other "stability" circuits from being employed.

D. A non-volatile changeable memory (EEROM) allows for adaptation to new environments.

E. Post accept gate discrimination. A second oscillator-excited coil is used as a means of detecting that a coin has successfully passed through the "acceptance" region. Measurements can be performed to determine if the passing coin is of the same class as the one accepted via the first coil.

While the foregoing description represents a preferred embodiment of the invention, it will be obvious to those skilled in the art that various changes and modifications may be made, without departing from the true spirit and scope of the invention as pointed out in the following claims.

What we claim is:

1. A technique of discriminating between acceptable and unacceptable coins deposited in a coin receiving slot associated with a vending machine, comprising:

guiding a deposited coin along a first guide path having a bottom for supporting the coin on its circumference as it travels said guide path;

arranging first coil means in a frequency determining part of an oscillator circuit, said oscillator circuit being operative over a test frequency range;

positioning a face of the first coil means at a side of the first guide path and at a determined height relative to the bottom of the first guide path such that only certain coins of at least a minimum diameter among coins in a given coin set in which some coins have diameters less than said minimum diameter, will operatively interact with flux produced by the first coil means when the coil means is excited by the oscillator circuit and said certain coins pass the face of the first coil means;

arranging said guide path so that a deposited coin is urged to present a side of the coin against the side of the guide path on which the first coil means is positioned as the coin moves past the face of the first coil means;

detecting the presence of a deposited coin of at least said minimum diameter, by monitoring a test amplitude of said oscillator circuit while operating in said test frequency range, and initiating a coin data acquisition mode when more than a preset difference in said rest amplitude is monitored;

measuring an amplitude value and a frequency value each corresponding to operation of the oscillator circuit in said test frequency range (1) in the absence of a proximate coin, and (2) when a deposited coin is at positions along the first guide path which are in proximity with the first coil means and said coin data acquisition mode has been initiated;

first determining a degree of shift in said amplitude value between measurements made at (1) and (2) in said measuring step;

second determining a degree of shift in said frequency value between measurements made at (1) and (2) in said measuring step;

comparing the degrees of shift obtained in the first and the second determining steps with known shift limits for acceptable coins; and judging an accept condition for a deposited coin according to a result obtained by said comparing step, including rejecting genuine coins of said given coin set which coins have less than said minimum diameter.

2. The technique of claim 1, including placing a coin arresting member downstream of the first guide path to hold a deposited coin at a rest position prior to judging said accept condition for the deposited coin, and actuating the coin arresting member thereby allowing the deposited coin to enter a second guide path leading to a coin collection box upon judging the deposited coin to be an acceptable coin.

3. The technique of claim 2, including positioning second coil means upstream of said second guide path thereby causing a coin just released by said coin arresting member to interact with flux produced by the second coil means when said second coil means is excited by an oscillator circuit and the released coin is proximate the second coil means.

4. The technique of claim 3, including providing an oscillator circuit with said second coil means in a frequency determining part of the oscillator circuit;

measuring a frequency value corresponding to operation of the oscillator circuit when exciting the second coil means (1) in the absence of said released coin, and (2) when the released coin is at positions along the second guide path which are in proximity with the second coil means, determining a degree of shift in said frequency value between measurements made at (1) and (2) in said measuring step, comparing the determined degree of frequency shift associated with the second coil means with a degree of frequency shift last determined in association with the first coil means, and judging a valid credit condition for the released coin according to a result obtained by said comparing step.

5. The technique of claim 1, including displaying a vend price and decrementing the displayed vend price by an amount corresponding to the value of a valid deposited coin.

6. Apparatus for discriminating between acceptable and unacceptable coins deposited in a coin receiving slot associated with a vending machine, comprising:

panel means arranged to be associated with a vending machine for defining a coin slot into which coins may be deposited from a front side of the panel means to operate the vending machine;

support means fixed with respect to a rear side of said panel means, including guide means for guiding a deposited coin along a first guide path, and flange means for supporting the coin on its circumference as it travels said guide path;

an oscillator circuit operative over a test frequency range;

first coil means coupled to a frequency determining part of the oscillator circuit and having a face positioned at a side of the guide means and at a determined height relative to the flange means, so that only certain coins of at least a minimum diameter among coins in a given coin set in which some coins have diameters less than said minimum diameter, will operatively interact with flux produced by the first coil means when the coil means is excited by said oscillator circuit and said certain coins pass the face of the first coil means;

said guide means being supported so that a deposited coin is urged to present a side of the coin against the side of the guide path on which the first coil means is positioned as the coin moves past the face of the coil means;

processor means for judging whether or not a coin deposited in said coin slot is acceptable to operate said vending machine, said processor means including coin deposit detection means for detecting the presence of a deposited coin of at least said minimum diameter, including means for monitoring a rest amplitude of said oscillator circuit while operating in said test frequency range, and for initiating a coin data acquisition mode when more than a preset difference in said rest amplitude is monitored;

first means for measuring an amplitude value and a frequency value each corresponding to operation of the oscillator circuit in said test frequency range (1) in the absence of a proximate coin, and (2) when a deposited coin is at positions along the first guide path which are in proximity with the first coil means and said coin data acquisition mode has been initiated, second means for determining a degree of shift in the amplitude value between measurements made at (1) and (2), third means for determining a degree of shift in the frequency value between measurements made at (1) and (2), fourth means for comparing the degrees of shift obtained by said second and said third means with known shift limits for acceptable coins, and fifth means for judging an accept condition for a deposited coin according to an operational result of said fourth means, including means for rejecting a genuine coin of said given coin set which coin has less than said minimum diameter.

7. Coin discriminating apparatus according to claim 6, including coin arresting means arranged downstream of said first guide path for holding a deposited coin at a rest position prior to judging said accept condition for the deposited coin, and actuator means for actuating the coin arresting means and for causing the deposited coin to enter a second guide path leading to a coin collection box upon judging the deposited coin to be an acceptable coin.

8. Apparatus according to claim 7, including second coil means located at a position upstream of said second guide path such that a coin just released by said coin arresting member will interact with flux produced by the second coil means when said second coil means is excited by an oscillator circuit and the released coin is proximate the second coil means.

9. Apparatus according to claim 8, including an oscillator circuit having a frequency determining part including said second coil means, and said processor means includes:

sixth means for measuring a frequency value corresponding to operation of the oscillator circuit when exciting the second coil means (1) in the absence of said released coin, and (2) when the released coin is at positions along the second guide path which are in proximity with the second coil means, seventh means for determining a degree of shift in said frequency value between measurements made at (1) and (2) by said sixth means;

eighth means for comparing the determined degree of frequency shift associated with the second coil means with a degree of frequency shift last determined in association with the first coil means, and ninth means for judging a valid credit condition for the released coin according to a result obtained by said comparing step.

10. Apparatus according to claim 6, including display means for displaying a vend price, and said processor means includes means for decrementing the displayed vend price by an amount corresponding to the value of a valid deposited coin.

11. Coin discriminating apparatus according to claim 6, wherein said guide means comprises a pair of generally rectangular coin guide walls extending in parallel, spaced apart relation to one another, each having lower and upper edges, and coin support means beneath the lower edges of said guide walls for supporting a deposited coin at lowermost points on the circumference of said coin as the coin travels between said guide walls.

12. Apparatus according to claim 11, wherein one of said guide walls has a front edge in alignment with a long edge of said coin slot, and an offset part broadening the spacing between said pair of guide walls upstream of said first guide path, wherein a leading point on the circumference of deposited coins having more than a certain entrance velocity will impact against said offset part and maintain a uniform velocity through a narrower spaced portion of said guide walls downstream of said offset part.

13. Apparatus according to claim 11, including guide wall support means for supporting said guide walls so that the walls lie in a plane that forms a certain offset angle with respect to the vertical.

14. Apparatus according to claim 13, wherein said offset angle is about 10 degrees.

15. Apparatus according to claim 11, wherein said first coil means fixed to an outside surface of one of said guide walls.

16. Apparatus according to claim 15, wherein a center axis of said first coil means is positioned so that designated coins to be deposited for credit will travel between said guide walls to interact substantially completely with the flux produced by the first coil means when excited by said oscillator circuit.

17. Apparatus according to claim 16, wherein the center axis of said coil means is positioned so that (1) only designated larger diameter coins of a given coin set will interact substantially completely with said flux, and (2) smaller diameter coins of said given coin set will not interact with said flux sufficiently to be discriminated and accepted by the apparatus even if the smaller diameter coins are genuine.

18. Coin discriminating apparatus according to claim 7, wherein said guide means comprises a pair of generally rectangular coin guide walls extending in parallel, spaced apart relation to one another, each having lower and upper edges, coin support means beneath the lower edges of said guide walls for supporting a deposited coin at lowermost points on the circumference of said coin as the coin travels between said guide walls, means for deflecting said guide walls for swinging movement between a first position at which front ends of the guide walls are aligned with said coin slot for receiving a coin deposited in said slot, and a second position for discharging an unaccepted deposited coin held between said guide walls at said rest position into a coin discharge passage, means for biasing said guide walls at said first position, and coin return means coupled to said deflecting means for urging said guide walls toward said second position for returning the unaccepted coin through said discharge passage in response to an outside force.

19. Apparatus according to claim 18, wherein said coin return means comprises a return actuator button extending from said panel means, and reject lever means coupled between said actuator button and said guide wall deflecting means for translating an actuating force applied to said actuator button from the front of said panel means into a force that urges the guide walls to deflect against a bias force of said biasing means from said first position to said second position.

20. A technique of discriminating between acceptable and unacceptable coins deposited in a coin receiving slot associated with a vending machine, comprising:

guiding a deposited coin along a first guide path having a bottom for supporting the coin on its circumference as it travels said guide path;

arranging a single coil winding in a frequency determining part of an oscillator circuit, said oscillator circuit being operative over a test frequency range;

positioning a face of the single coil winding at a side of the first guide path and at a determined height relative to the bottom of the first guide path such that only certain coins of at least a minimum diameter will operatively interact with flux produced by the single coil winding when the coil winding is excited by the oscillator circuit and the coins pass the face of the coil winding;

arranging said guide path so that a deposited coin is urged to present a side of the coin against the side of the guide path on which the single coil winding is positioned as the coin moves past the face of the coil winding;

detecting the presence of a deposited coin of at least said minimum diameter, by monitoring a rest amplitude of said oscillator circuit while operating in said test frequency range, and initiating a coin data acquisition mode when more than a preset difference in said rest amplitude is monitored;

measuring a signal amplitude value on said single coil winding and simultaneously measuring a frequency value at a terminal of said oscillator circuit whereby each of said values corresponds to operation of the oscillator circuit in said test frequency range (1) in the absence of a proximate coin, and (2) when a deposited coin is at positions along the first guide path which are in proximity with the single coil winding and said coin data acquisition mode has been initiated;

first determining a degree of shift in said amplitude value between measurements made at (1) and (2) in said measuring step;

second determining a degree of shift in said frequency value between measurements made at (1) and (2) in said measuring step;

comparing the degrees of shift obtained in the first and the second determining steps with known shift limits for acceptable coins; and judging an accept condition for a deposited coin according to a result obtained by said comparing step, including rejecting a genuine coin having less than said minimum diameter.

21. The technique of claim 20, including placing a coin arresting member downstream of the first guide path to hold a deposited coin at a rest position prior to judging said accept condition for the deposited coin, and actuating the coin arresting member thereby allowing the deposited coin to enter a second guide path leading to a coin collection box upon judging the deposited coin to be an acceptable coin.

22. The technique of claim 21, including positioning coil means other than said single coil winding upstream of said second guide path thereby causing a coin just released by said coin arresting member to interact with flux produced by the other coil means when said other coil means is excited by an oscillator circuit and the released coin is proximate the other coil means.

23. The technique of claim 22, including providing an oscillator circuit with said other coil means in a frequency determining part of the oscillator circuit;

measuring a frequency value corresponding to operation of the oscillator circuit when exciting the other coil means (1) in the absence of said released coin, and (2) when the released coin is at positions along the second guide path which are in proximity with the other coil means, determining a degree of shift in said frequency value between measurements made at (1) and (2) in said measuring step, comparing the determined degree of frequency shift associated with the other coil means with a degree of frequency shift last determined in association with said single coil winding, and judging a valid credit condition for the released coin according to a result obtained by said comparing step.

24. The technique of claim 20, including displaying a vend price and decrementing the displayed vend price by an amount corresponding to the value of a valid deposited coin.

25. Apparatus for discriminating between acceptable and unacceptable coins deposited in a coin receiving slot associated with a vending machine, comprising:

panel means arranged to be associated with a vending machine for defining a coin slot into which coins may be deposited from a front side of the panel means to operate the vending machine;

support means fixed with respect to a rear side of said panel means, including guide means for guiding a deposited coin along a first guide path, and flange means for supporting the coin on its circumference as it travels said guide path;

an oscillator circuit operative over a test frequency range;

a single coil winding connected in a frequency determining part of the oscillator circuit and having a face positioned at a side of the guide means and at a determined height relative to the flange means, so that only certain coins of at least a minimum diameter will operatively interact with flux produced by the single coil winding when the coil winding is excited by said oscillator circuit and the coins pass the face of the single coil winding;

said guide means being supported so that a deposited coin is urged to present a side of the coin against the side of the guide path on which the single coil winding is positioned as the coin moves past the face of the coil winding; and processor means for judging whether or not a coin deposited in said coin slot is acceptable to operate said vending machine, said processor means including coin deposit detection means for detecting the presence of a deposited coin of at least said minimum diameter, including means for monitoring a rest amplitude of said oscillator circuit while operating in said test frequency range, and for initiating a coin data acquisition mode when more than a preset difference in said rest amplitude is monitored;

first means for measuring a signal amplitude value on said single coil winding and for simultaneously measuring a frequency value at a terminal of said oscillator circuit wherein each of said values corresponds to operation of the oscillator circuit in said test frequency range (1) in the absence of a proximate coin, and (2) when a deposited coin is at positions along the first guide path which are in proximity with the single coil winding and said coin data acquisition mode has been initiated, second means for determining a degree of shift in the amplitude value between measurements made at (1) and (2), third means for determining a degree of shift in the frequency value between measurements made at (1) and (2), fourth means for comparing the degrees of shift obtained by said second and said third means with known shift limits for acceptable coins, and fifth means for judging an accept condition for a deposited coin according to an operational result of said fourth means, including means for rejecting a genuine coin having less than said minimum diameter.

26. Coin discriminating apparatus according to claim 25, including coin arresting means arranged downstream of said first guide path for holding a deposited coin at a rest position prior to judging said accept condition for the deposited coin, and actuator means for actuating the coin arresting means and for causing the deposited coin to enter a second guide path leading to a coin collection box upon judging the deposited coin to be an acceptable coin.

27. Apparatus according to claim 26, including coil means other than said single coil winding located at a position upstream of said second guide path such that a coin just released by said coin arresting member will interact with flux produced by the other coil means when said other coil means is excited by an oscillator circuit and the released coin is proximate the other coil means.

28. Apparatus according to claim 27, including an oscillator circuit having a frequency determining part including said other coil means, and said processor means includes:

sixth means for measuring a frequency value corresponding to operation of the oscillator circuit when exciting the other coil means (1) in the absence of said released coin, and (2) when the released coin is at positions along the second guide path which are in proximity with the other coil means, seventh means for determining a degree of shift in said frequency value between measurements made at (1) and (2) by said sixth means;

eighth means for comparing the determined degree of frequency shift associated with the other coil means with a degree of frequency shift last determined in association with said single coil winding, and ninth means for judging a valid credit condition for the released coin according to a result obtained by said comparing step.

29. Apparatus according to claim 25, including display means for displaying a vend price, and said processor means includes means for decrementing the displayed vend price by an amount corresponding to the value of a valid deposited coin.

30. Coin discriminating apparatus according to claim 25, wherein said guide means comprises a pair of generally rectangular coin guide walls extending in parallel, spaced apart relation to one another, each having lower and upper edges, and coin support means beneath the lower edges of said guide walls for supporting a deposited coin at lowermost points on the circumference of said coin as the coin travels between said guide walls.

31. Apparatus according to claim 30, wherein one of said guide walls has a front edge in alignment with a long edge of said coin slot, and an offset part broadening the spacing between said pair of guide walls upstream of said first guide path, wherein a leading point on the circumference of deposited coins having more than a certain entrance velocity will impact against said offset part and maintain a uniform velocity through a narrower spaced portion of said guide walls downstream of said offset part.

32. Apparatus according to claim 30, including guide wall support means for supporting said guide walls so that the walls lie in a plane that forms a certain offset angle with respect to the vertical.

33. Apparatus according to claim 32, wherein said offset angle is about 10 degrees.

34. Apparatus according to claim 30, wherein said single coil winding is fixed to an outside surface of one of said guide walls.

35. Apparatus according to claim 34, wherein a center axis of said single coil winding is positioned so that designated coins to be deposited for credit will travel between said guide walls to interact substantially completely with the flux produced by the single coil winding when excited by said oscillator circuit.

36. Apparatus according to claim 35, wherein the center axis of said single coil winding is positioned so that (1) only designated larger diameter coins of a given coin set will interact substantially completely with said flux, and (2) smaller diameter coins of said given coin set will not interact with said flux sufficiently to be discriminated and accepted by the apparatus even if the smaller diameter coins are genuine.

37. Coin discriminating apparatus according to claim 26, wherein said guide means comprises a pair of generally rectangular coin guide walls extending in parallel, spaced apart relation to one another, each having lower and upper edges, coin support means beneath the lower edges of said guide walls for supporting a deposited coin at lowermost points on the circumference of said coin as the coin travels between said guide walls, means for deflecting said guide walls for swinging movement between a first position at which front ends of the guide walls are aligned with said coin slot for receiving a coin deposited in said slot, and a second position for discharging an unaccepted deposited coin held between said guide walls at said rest position into a coin discharge passage, means for biasing said guide walls at said first position, and coin return means coupled to said deflecting means for urging said guide walls toward said second position for returning the unaccepted coin through said discharge passage in response to an outside force.

38. Apparatus according to claim 37, wherein said coin return means comprises a return actuator button extending from said panel means, and reject lever means coupled between said actuator button and said guide wall deflecting means for translating an actuating force applied to said actuator button from the front of said panel means into a force that urges the guide walls to deflect against a bias force of said biasing means from said first position to said second position.

* * * * *